United States Patent [19]

Walsh

[11] Patent Number: 5,031,905

[45] Date of Patent: Jul. 16, 1991

[54] EXERCISING DEVICE

[76] Inventor: Russell B. Walsh, 1926 Knollwood Dr., Sanford, N.C. 27330

[21] Appl. No.: 542,194

[22] Filed: Jun. 21, 1990

[51] Int. Cl.[5] ..... A63B 23/04

[52] U.S. Cl. ..... 272/130; 272/134; 272/145; 128/75

[58] Field of Search ..... 272/130, 134, 144, 145; 297/60, 326, 327, 335; 128/75, 78

[56] References Cited

U.S. PATENT DOCUMENTS

| | | | |
|---|---|---|---|
| 1,344,255 | 6/1920 | Beckman . | |
| 4,502,682 | 3/1985 | Miller . | |
| 4,534,554 | 8/1985 | Miller . | |
| 4,546,972 | 10/1985 | Goyer . | |
| 4,672,697 | 6/1987 | Schürch | 272/145 |
| 4,688,557 | 8/1987 | Bradstreet | 128/75 |
| 4,717,148 | 1/1988 | Brewer . | |
| 4,753,438 | 6/1988 | Paris . | |
| 4,838,250 | 6/1989 | Angelo | 128/75 |
| 4,867,143 | 7/1989 | Morin | 272/144 |

*Primary Examiner*—Richard J. Apley
*Assistant Examiner*—Lynne A. Reichard
*Attorney, Agent, or Firm*—Rhodes, Coats & Bennett

[57] ABSTRACT

A tiltable body exercising device for exercising the lower body including the abdomen and legs. The exerciser includes a seat for supporting the person doing the exercise, padded supports that hold the back of the knees, and a pair of supports at the bottom for supporting the front and back of the feet. The control arms for the knee, feet, and seat are of unequal length and movable between a first sitting position and a second elevated position wherein the relative positions of the feet and knees are varied to permit the person doing the exercise to perform inverted sit-ups and leg exercises. A pair of handles adjacent to the knee pads may be used to aid the person doing the exercise to achieve and reverse the elevated position. Stops on the upper control arm and the bottom of the seat restrict the range of movement of the tiltable exerciser. In a similar manner, the bottom foot support acts as a place for the feet to push against when the person doing the exercise comes back to a sitting position. The bottom foot support also acts as a catch for the feet when the person doing the exercise comes back to a sitting position.

7 Claims, 3 Drawing Sheets

FIG. 3
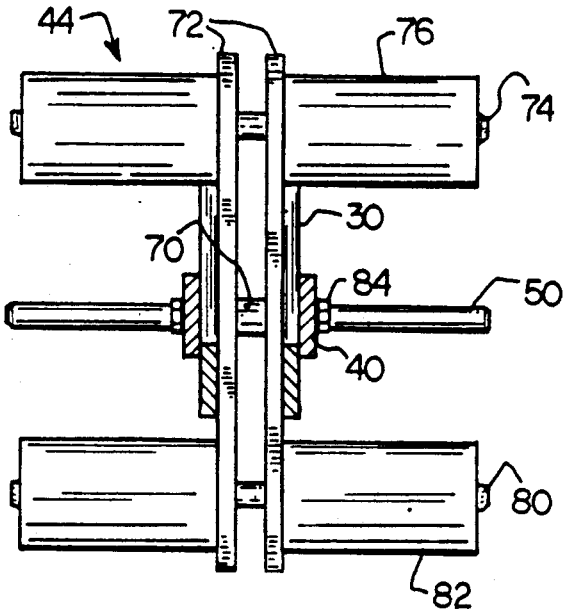
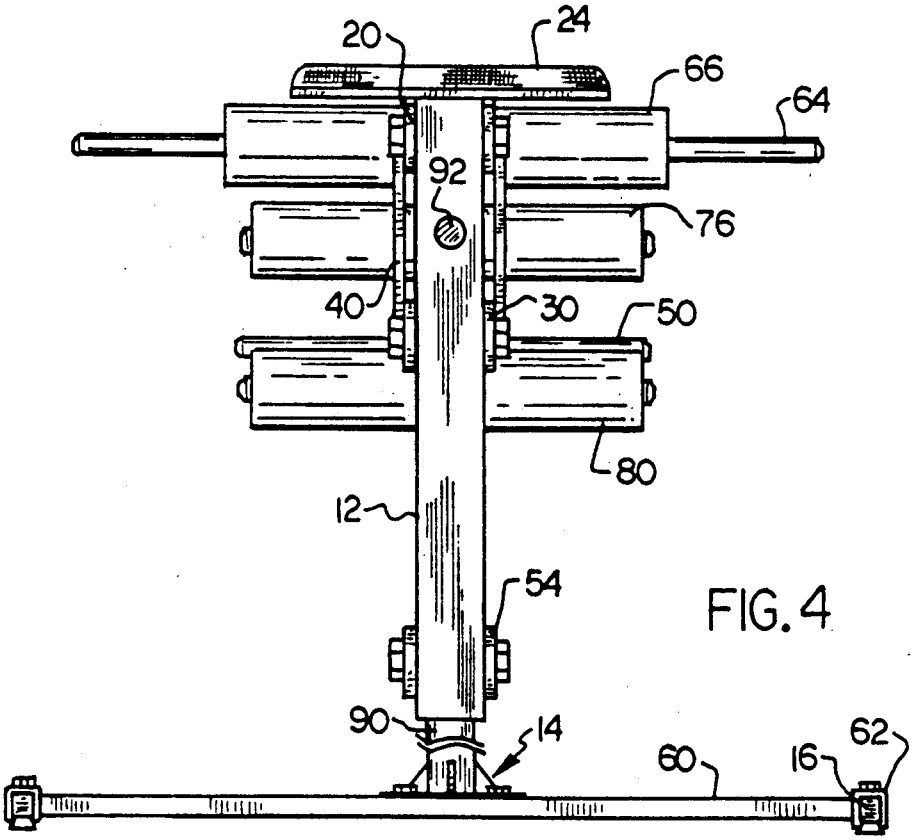
FIG. 4

EXERCISING DEVICE

BACKGROUND OF THE INVENTION

1. Field of the Invention

The present invention relates generally to exercising devices and, more particularly, to a tiltable body exercising device for exercising the lower body including the abdomen and legs.

2. Description of the Prior Art

The last decade has brought an explosion of interest in physical fitness. Along with this interest has come a number of mechanical devices which aid the exerciser in doing the exercise properly which both improves the results obtained and lessens the likelihood of injury. One successful line of such equipment is popularly known as NAUTILUS.

One piece of equipment which has traditionally been used to exercise the abdomen and leg muscles is the inverted sit-up board. This board attaches to the wall at one end and has a place to lock the exerciser's feet at the same end. The other end rests on the floor. The wall mounted end may be raised up to about 45 degrees to increase the effectiveness of sit-ups by using the exerciser's own weight as resistance when doing these "inverted" sit-ups.

Morin U.S. Pat. No. 4,867,143, discloses a device for the treatment of back trouble which includes a stand supporting a reclining board. This device is generally similar to other so-called "gravity" boards with the exception that the reclining board is mounted on wheels to reduce the friction that the person doing the exercise would normally feel during the inverted condition. The reclining board as taught by Morin includes a foot plate which is fixed with respect to the reclining board and could no readily be adapted for doing inverted sit-ups Goyer U.S. Pat. No. 4,546,972, discloses a tiltable body exerciser which includes a two-position pivoted support structure allowing the exerciser to be tilted about a first or second pivot axis. While the exerciser as taught by Goyer is selectable between two axes of rotation, the relative positions of the foot holder and the board remain fixed.

U.S. Pat. No. 1,344,255 discloses another tiltable exercise device wherein the exerciser remains seated rather than standing, however, like the other references the relative positions of the feet and seat remain fixed.

Thus, there remains a need for a tiltable body exercising device for exercising the lower body including the abdomen and legs which is movable from a first sitting upright position to a second elevated position wherein the relative positions of the feet and knees are varied to permit the person doing the exercise to perform inverted sit-ups and leg exercises.

SUMMARY OF THE INVENTION

The present invention is directed to a tiltable body exercising device. The exerciser is movable from a first sitting upright position to a second elevated position. The exerciser includes a seat for supporting the person doing the exercise, padded supports that hold the back of the knees, and a pair of supports at the bottom for supporting the front and back of the feet. The control arms for the knee, feet, and seat are of unequal length and movable between a first sitting position and a second elevated position wherein the relative positions of the feet and knees are varied to permit the person doing the exercise to perform inverted sit-ups and leg exercises.

A pair of handles adjacent to the knee pads may be used to aid the person doing the exercise to achieve and reverse the elevated position. In a similar manner, the bottom foot support acts as a place for the feet to push against when the person doing the exercise comes back to a sitting position. The bottom foot support also acts as a catch for the feet when the person doing the exercise comes back to a sitting position. Stops between the upper control arm and the bottom of the seat restrict the range of movement of the tiltable exerciser.

The support frame for the exerciser includes an upright post attached at the bottom to a cross member and a pair of movable legs attached to the ends of the cross member and perpendicular thereto for preventing the exercising device from overturning. In a permanent facility, the upright post could be mounted directly to the floor.

Accordingly, one aspect of the present invention is to provide an exercise device for exercising the lower body including the abdomen and legs. The device includes a stationary supporting frame; an elongated upper control arm having one end pivotally attached to the upper portion of said stationary support frame and the other end adapted for supporting the back of the exerciser's knees; seat means attached to said elongated upper control arm at the end adjacent to said stationary support frame for supporting the exerciser's buttocks; and means for moving said elongated upper control arm and seat means from a first seating position to a second elevated position adapted for exercising the lower body including the abdomen and legs.

Another aspect of the present invention is to provide an exercise device which includes a stationary supporting frame; an elongated upper control arm having one end pivotally attached to the upper portion of said stationary support frame and the other end adapted for supporting the back of the exerciser's knees; seat means attached to said elongated upper control arm at the end adjacent to said stationary support frame for supporting the exerciser's buttocks; means for moving said elongated upper control arm and seat means from a first seating position to a second elevated position adapted for exercising the lower body including the abdomen and legs; and means for limiting the movement of said elongated upper control arm and seat means to said second elevated position.

Still another aspect of the present invention is to provide an exercise device which includes a stationary supporting frame; an elongated upper control arm having one end pivotally attached to the upper portion of said stationary support frame and the other end adapted for supporting the back of the exerciser's knees; seat means attached to said the elongated upper control arm at the end adjacent to said stationary support frame for supporting the exerciser's buttocks; means for moving said elongated upper control arm and seat means from a first seating position to a second elevated position adapted for exercising the lower body including the abdomen and legs; means for limiting the movement of said elongated upper control arm and seat means to said second elevated position; and means for returning said elongated upper control arm and seat means from said second elevated position adapted for exercising the lower body including the abdomen and legs to said first seating position.

These and other aspects of the present invention will become apparent to those skilled in the art after a reading of the following description of the preferred embodiment when considered with the drawings.

BRIEF DESCRIPTION OF THE DRAWINGS

FIG. 3 is an enlarged vertical cross-sectional view of the exercising device shown in FIG. 1, taken along line 3—3;

FIG. 4 is a rear elevational view of the exercising device shown in FIG. 1; and

DESCRIPTION OF THE PREFERRED EMBODIMENTS

In the following description, like references characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
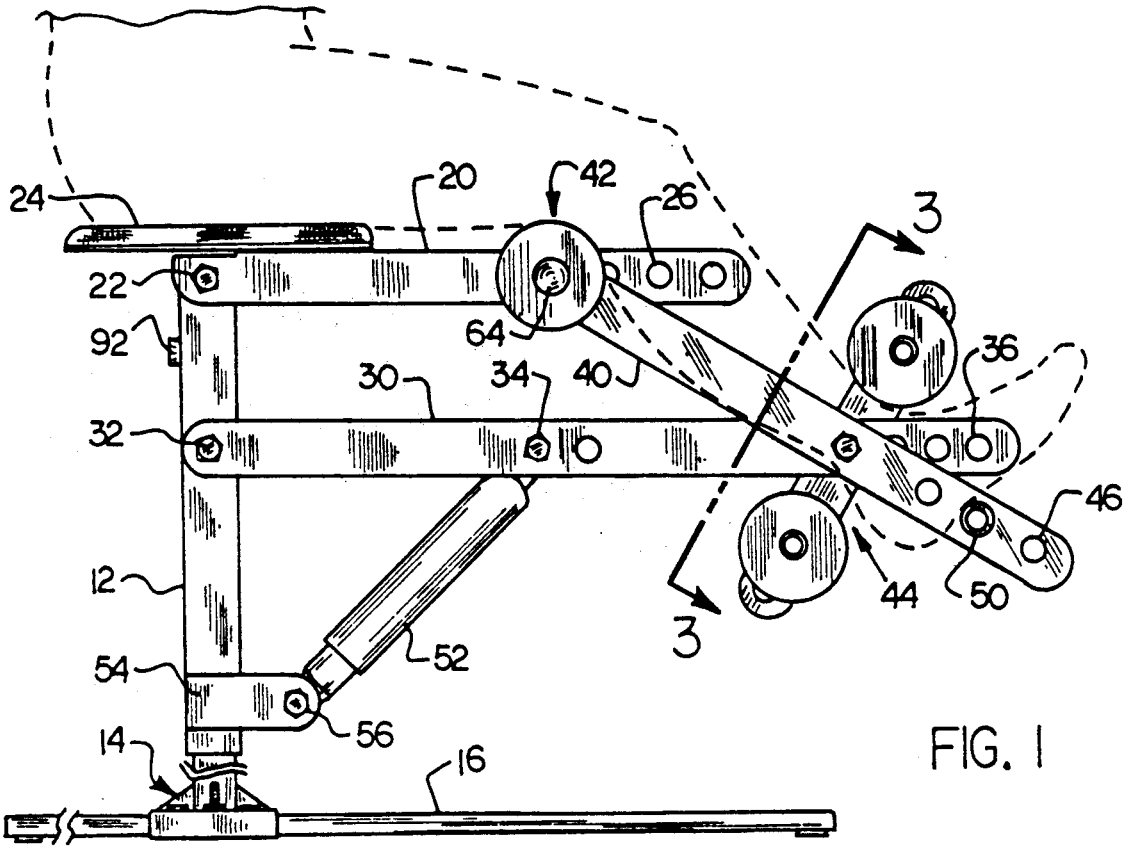
FIG. 1 is a side elevational view of an exercising device constructed according to the present invention.

Referring now to the drawings in general and FIG. 1 in particular, it will be understood that the illustrations are for the purpose of describing a preferred embodiment of the invention and are not intended to limit the invention thereto. As best seen in FIG. 1, an exercising device, generally designated 10, is shown constructed according to the present invention. Exercising device 10 consists of a support post 12 attached at one end to a base 14 having legs 16 for stabilizing and maintaining the support post 12 in a generally upright position. An upper frame arm 20 is attached at one end to support post 12 by pivot 22. A seat 24 is attached to the upper surface of upper frame arm 20 at the end of the upper frame arm 20 adjacent to pivot 22. A plurality of apertures 26 extend through upper frame arm 20 at its opposite end.

A lower frame arm 30 is attached to support post 12 by pivot 32. Approximately midway along lower control arm 30 and at the end opposite support post 12 are a plurality of apertures 34,36. Upper and lower frame arms 20, 30 lie in approximately the same plane with one another and are substantially equal distantly spaced from one another.

An inclined frame arm 40 is attached at one end to one of the plurality of apertures 26 in upper control arm 20. A pivot and knee rest assembly 42 permits upper frame arm 20 and inclined frame arm 40 to move with respect to one another. Adjacent to the other end of inclined frame arm 40 is a pivot and foot/ankle pad assembly 44 which permits lower frame arm 30 and inclined frame arm 40 to move with respect to one another. A plurality of apertures 46 extend through inclined frame arm 40 at the end opposite upper frame arm 20. Apertures 46 permit a tubular footrest 50 to be inserted therein.

A conventional shock absorber 52 may be attached at one end to apertures 34 and at the other end to a bracket 54. Bracket 54 is welded to support post 12 and includes a pivot point 56 for permitting the shock absorber 52 to move relative thereto. The shock absorber 52 cushions the stops by limiting the speed of movement of the control arms 20,30 and provides some additional resistance to the movement of the control arms 20,30.

Figure 2:
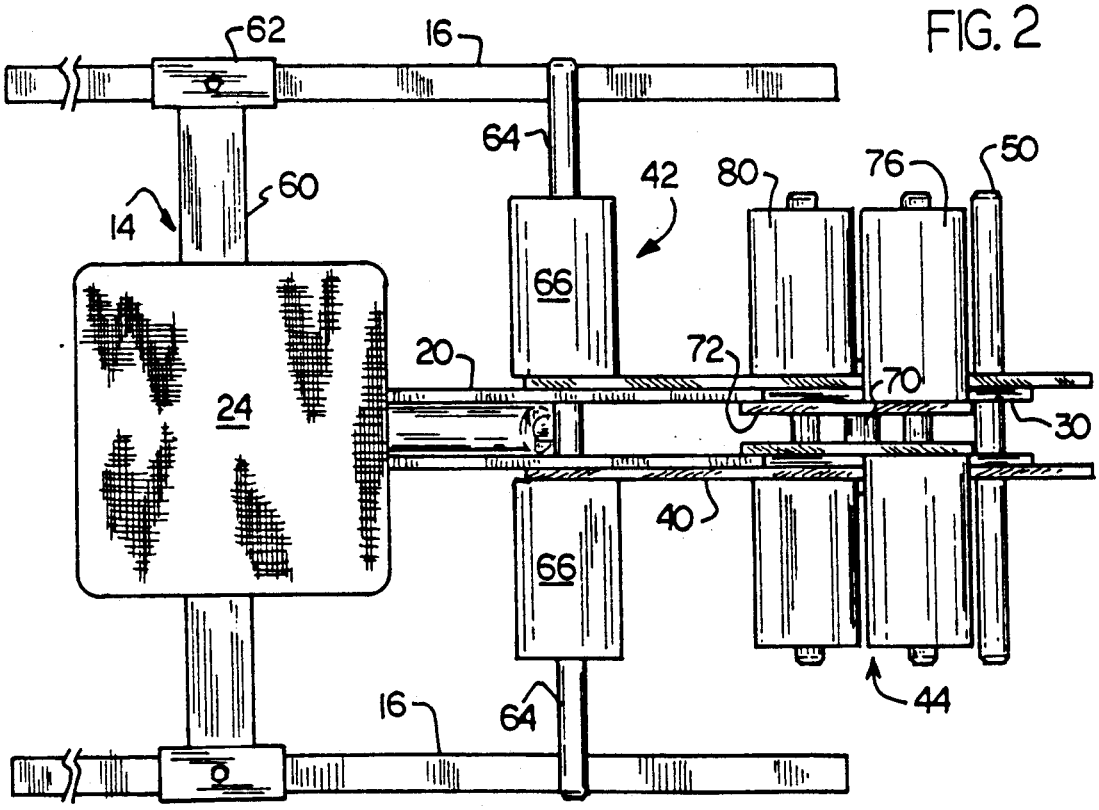
FIG. 2 is a top plan view of the exercising device shown in FIG. 1.

As best seen in FIG. 2, the base 14 includes a generally elongated bar 60 which is attached in its middle to the lower end of the support post 12. Each end of bar 60 includes an elongated, rectangular cross-sectional tube welded thereon for slidably receiving legs 16.

In the preferred embodiment, upper frame arm 20, lower frame arm 30, and inclined frame arm 40 consist of pairs of parallel, elongated metal stripes. However other geometries, for example, a rectangular cross-section tube, should perform equally well. As can also be seen in FIG. 2, the pivot and knee-rest assembly 42 consists of a elongated rod 64 extending through the pivot point connecting upper frame arm 20 with inclined frame arm 40. Pads 66 are slidably received on elongated rod 64 for providing support to the back of the exerciser's knees.

As best seen in FIG. 3, the pivot and foot/ankle pad assembly 44 consists of a hollow cylindrical tube 70 connecting a pair of flat metal strips 72. An upper foot rod 74 extends through an aperture located on one end of arm 72. A pair of cushions are slidable received upon the upper footrest 74 providing support to the upper foot portion of the exerciser. Similarly, a lower heel rod 80 is received through an aperture on the other end of arm 72 and likewise a cushion pad 82 is slidably received thereupon. Finally, a removable pin or bolt and nut assembly 84 passes through hollow cylindrical portion 70 and engages lower control arm 30 and inclined frame arm 40 to complete the assembly.

As can be seen in FIG. 4, the support post 12 may include a lower support post 90 which is received in the upper support post 12 to permit height adjustment of the stand. A bolt or pin arrangement (not shown) extending through both upper support post 12 and lower support post 90 can be used to permit height adjustments.

Figure 5:
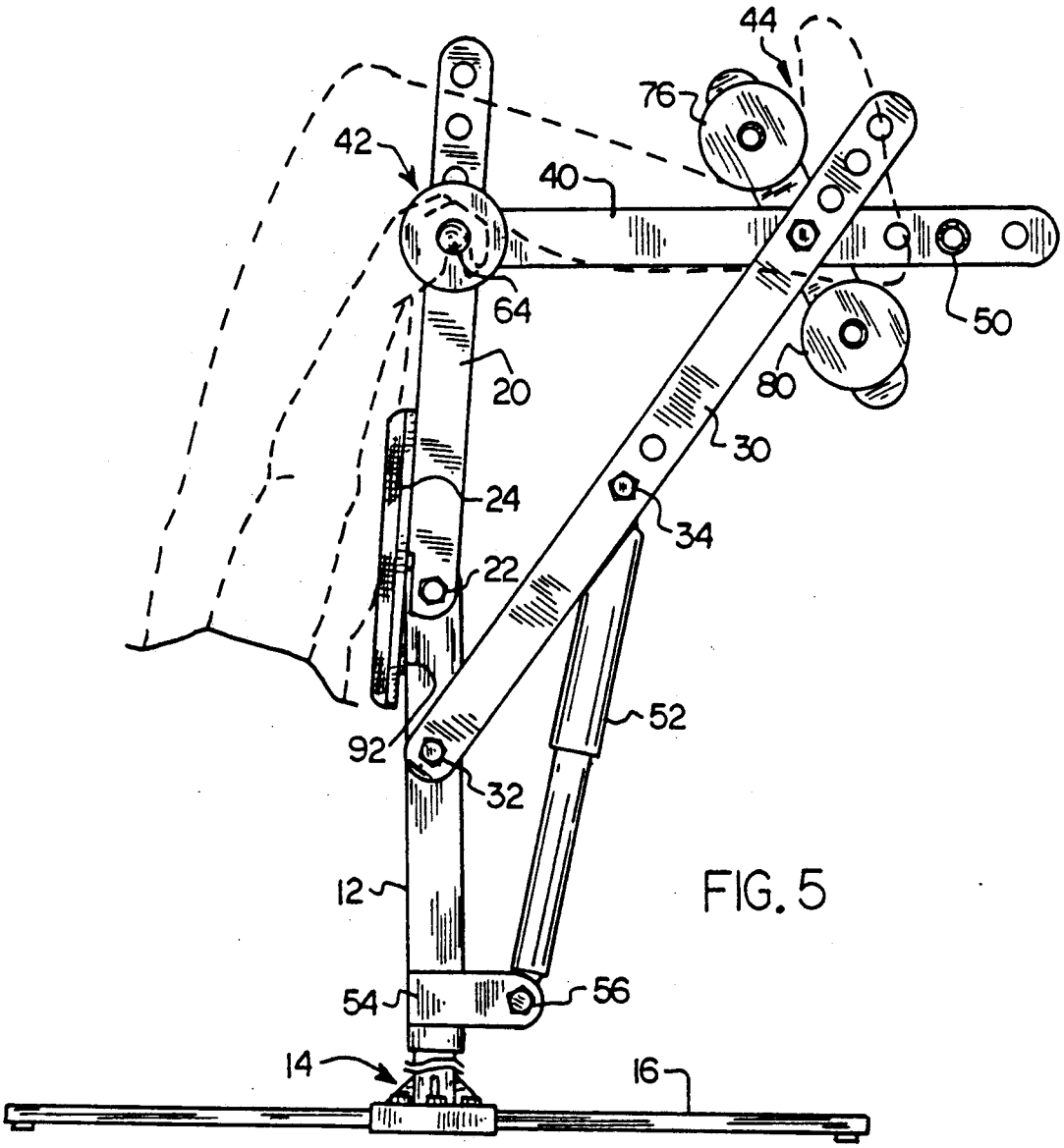
FIG. 5 is a partial side elevational view of the exercising device shown in FIG. 1, shown in its fully elevated position.

Finally, turning to FIG. 5, there is shown a partial elevation view of the exercising device shown in FIG. 1 shown in its fully elevated position. As can be seen, a adjustable stop 92 located in the upper portion of support post 12 contacts the lower surface of seat 24 to limit the movement thereof.

In operation, the exerciser first straddles upper control arm 20 and sits upon seat 24. The exerciser then places his feet upon foot rest 50 and locks his feet between foot and heel pads 44 and, if needed, grasps the ends of rod 64 with each hand. In a smooth motion, the exerciser leans backward, while holding rod 64 if needed, and bending his legs about the knees. This action cause upper and lower control arms 20, 30 to pivot with respect to post 12 until the exerciser is hanging substantially upside down. At this point the exerciser can release the ends of rod 64, if desired, and proceed to exercise his lower body including the abdomen and legs by using the resistant of the exerciser's own body weight. After performing the exercises, the exerciser grasps the ends of rod 64 again, if needed, and pulls himself forward while extending his legs, thereby returning himself to his original sitting position.

Certain modifications and improvements will occur to those skilled in the art upon reading of the foregoing description. By way of example, the shock absorber and lower control arm could be replaced by a one-piece assembly having a single pivot point. Furthermore, the shock absorber could be replaced with a hydraulic or electrical actuator to automate the movement of the control arms. It should be understood that all such modifications and improvements have been deleted herein for the sake of conciseness and readability but are properly within the scope of the following claims.

I claim:

1. An exercise device comprising:

(a) a stationary supporting frame;

(b) an elongated upper control arm having one end pivotally attached to the upper portion of said stationary support frame and the other end adapted for supporting the back of a user's knees;

(c) seat means attached to said elongated upper control arm at the end adjacent to said stationary support frame for supporting the user's buttocks; and (d) means for moving said elongated upper control arm and seat means from a first seating position to a second elevated position adapted for exercising the lower body including the abdomen and legs, wherein said means for moving said elongated upper control arm and seat means from said first seating position to said second elevated position includes an elongated lower control arm having one end pivotally attached to said upper control arm adjacent the end opposite to said upper portion of said stationary support frame and the other end pivotally attached to the upper portion of said stationary support frame and wherein said means for moving said elongated upper control arm and seat means from said first seating position to said second elevated position further includes an inclined frame arm attached between said elongated lower control arm and said upper control arm adjacent the ends opposite to said upper portion of said stationary support frame, said inclined frame arm extending beyond said elongated lower control arm and having means for supporting the lower portion of the user's feet.

2. The apparatus according to claim 1, further including means for supporting the upper foot and heel of the user.

3. The apparatus according to claim 1, wherein said stationary support frame includes a base and a vertically oriented elongated post attached at one end to said base and at the other end to said upper control arm.

4. The apparatus according to claim 3, wherein said vertically oriented elongated post attached at one end to said base and at the other end to said upper control arm may be adjusted at least between a first height and a second height to better facilitate the use of said device by users of different heights.

5. The apparatus according to claim 3, wherein said base includes an elongated center portion having each end adapted to slidably receive one of a pair of elongated legs, said elongated center portion and said pair of legs lying in the plane perpendicular to said elongated post.

6. An exercise device comprising:

(a) a stationary supporting frame;

(b) an elongated upper control arm having one end pivotally attached to the upper portion of said stationary support frame and the other end adapted for supporting the back of a user's knees;

(c) seat means attached to said elongated upper control arm at the end adjacent to said stationary support frame for supporting the user's buttocks;

(d) means for moving said elongated upper control arm and seat means from a first seating position to a second elevated position adapted for exercising the lower body including the abdomen and legs; and (e) means for limiting the movement of said elongated upper control arm and seat means to said second elevated position, wherein said means for limiting the movement of said elongated upper control arm and seat means to said second elevated position includes a threaded stop located between the upper portion of said stationary supporting frame and said seat means.

7. An exercise device comprising:

(a) a stationary supporting frame;

(b) an elongated upper control arm having one end pivotally attached to the upper portion of said stationary support frame and the other end adapted for supporting the back of a user's knees;

(c) seat means attached to said elongated upper control arm at the end adjacent to said stationary support frame for supporting the user's buttocks;

(d) means for moving said elongated upper control arm and seat means from a first seating position to a second elevated position adapted for exercising the lower body including the abdomen and legs;

(e) means for limiting the movement of said elongated upper control arm and seat means to said second elevated position; and (f) means for returning said elongated upper control arm and seat means from said second elevated position adapted for exercising the lower body including the abdomen and legs to said first seating position, wherein said means for returning said elongated upper control arm and seat means from said second elevated position includes a tubular frame extending concentrically therefrom the portion of said elongated upper control arm adapted for supporting the back of the user's knees and wherein said means for returning said elongated upper control arm and seat means from said second elevated position further includes a shock adsorbing means attached between said means for moving said elongated upper control arm and seat means from a first seating position to a second elevated position and said stationary supporting frame.

* * * * *